US005337530A

United States Patent [19]

Beames

[11] Patent Number: 5,337,530

[45] Date of Patent: Aug. 16, 1994

[54] BUILDING WALL CONSTRUCTION

[76] Inventor: Douglas M. Beames, 12 Frost Street, Mt. Gravatt, Queensland, 4122, Australia

[21] Appl. No.: 149,010

[22] Filed: Nov. 8, 1992

Related U.S. Application Data

[63] Continuation of Ser. No. 867,898, Apr. 13, 1992, abandoned.

[51] Int. Cl.[5] ..... E04B 2/30

[52] U.S. Cl. ..... 52/426; 52/427; 52/564; 52/779

[58] Field of Search ..... 52/426, 427, 564, 779

[56] References Cited

U.S. PATENT DOCUMENTS

| | | | |
|---|---|---|---|
| 963,776 | 7/1910 | Kosack | 52/426 |
| 1,556,066 | 10/1925 | Bell | 52/564 |
| 1,953,287 | 4/1934 | Bemis | 52/428 |
| 3,729,883 | 5/1973 | Thompson | 52/779 |
| 4,106,251 | 8/1978 | Nelsson | 52/774 |
| 4,332,119 | 6/1982 | Toews | 52/481 |

FOREIGN PATENT DOCUMENTS

| | | | |
|---|---|---|---|
| 800990 | 7/1949 | Fed. Rep. of Germany | 52/425 |

*Primary Examiner*—Carl D. Friedman
*Assistant Examiner*—Christopher Todd Kent
*Attorney, Agent, or Firm*—Abelman, Frayne & Schwab

[57] ABSTRACT

A wall in which hollow units analogous to blocks are built up in overlapping superimposed courses, each unit having two spaced parallel vertical panels of skins of rectangular form, the units being held by concealed fastening members; characterized in that each panel has edge grooves extending along its upper and lower horizontal surfaces to be contiguous with those of adjacent panels, and each fastening member has a body portion to extend between spaced panels, the ends of the body portion each having hook portions extending upwards and downwards respectively into adjacent grooves of the panel edges, while said body portion between adjacent panels has two upper lugs extending into contact with respective upper panels, and two lower lugs extending down and into contact with respective spaced lower panels, the fastening member, constituting a one piece connector and spacing member.

1 Claim, 4 Drawing Sheets

BUILDING WALL CONSTRUCTION

This application is a continuation of application Ser. No. 07/867,989, filed Apr. 13, 1992 now abandoned.

TECHNICAL FIELD

This invention relates to building wall constructions, and it has particular reference to a novel method of and means for constructing a wall of the type having spaced, parallel, vertical panel assemblies interconnected to form a cavity-wall structure or one filled with concrete or other cementatious materials, insulating materials or other desires filling, such as fire-retarding polyurethane foam or the like. The invention also is applicable to the mounting of wall cladding on a wall.

BACKGROUND ART

Many different wall construction techniques have been devised to date in order to avoid the use of heavy solid building blocks of concrete and the like, a typical construction being one in which initially-hollow units similar to blocks are made up of relatively thin rectangular panels or so-called "skins" arranged in spaced parallel vertical relationship and laterally in register, interconnected preferably by concealed fasteners. Units of this type can be used like blocks in overlapping courses or tiers on a horizontal foundation and built up to the desired wall formation, being either used as a cavity-type wall or as a form assembly into which concrete or other material may be poured, usually being poured progressively as the wall units are placed in position.

Examples of such wall constructions can be found in numerous prior patent specifications, such as that of U.S. Pat. No. 4,433,520 of Jack Maschhoff which shows constructions aimed generally at achieving some of the principal benefits of using these methods by comparison with the use of solid blocks. However, the Maschhoff features leave room for considerable improvements in certain respects, particularly so far as the interconnecting means or concealed fasteners are concerned.

My present invention has been devised to overcome or alleviate the disadvantages and shortcomings associated with the building of walls by methods and means as set out above, and it has for its principal object the provision of a novel system for building a wall of the type described using concealed fastening clips of such improved nature that firm and accurate location of components may be achieved with maximum simplicity.

The invention further aims to provide a total system of method and components which will be more effective than hitherto in providing either a cavity-type wall or a filled wall, but which lends itself most readily to use as a concrete/foam, sacrificed form work constructions system. The invention has a further object to provide such a system in which the hollow units are assembled and erected in groups skin to standard blocks, and they are then filled with concrete, steel reinforcing being placed during erection if required, while plumbing and electrical services can be similarly introduced before pouring, the invention being designed so that fire retarding polyurethane foam could be used as the filler in some cases, such as in home construction walls.

Another object of the invention is to provide a wall construction system of the character described which enables a selected wall finish to be achieved, either by finishing the erected walls in the desired covering or by using pre-rendered panels. For example, in up-market situations, stone veneers maybe pre-fixed to the panels to give the appearance of a stone-like block.

Yet another object of the invention is to provide a novel form of concealed clip for use with the structures described above, such clip being made relatively easily and inexpensively, being simple to affix, extremely secure and effective in operation, and acting to reduce substantially the number of components previously considered necessary to effect concealed fixing.

Other objects and advantages of the invention will be hereinafter apparent, particularly those applying to the generally application of system of this type, such as transportability of components, and ease and speed of erection using unskilled labour with competent supervision. Such a system also will be found very cost effective, while having unlimited application in relation to low rise up to high rise constructions, and external and internal walls can be assembled ready for final finishes or coverings with minimum surface preparation.

While the initial objects of the invention have been in relation to the building of walls having spaced skins as aforementioned, another object is to use similar principles in attaching a cladding sheet to a wall structure, whether the latter be an existing wall of known type or one having spaced skins according to the present invention.

DISCLOSURE OF THE INVENTION

With the foregoing and other objects in view, the invention resides broadly, according to one aspect, in a wall construction method in which hollow units analogous to blocks are built up in overlapping superimposed courses, each unit having two spaced parallel vertical panels or skins of rectangular form, the units being held by concealed fastening members; characterized in that each panel has edge grooves extending along its upper and lower horizontal surfaces to be contiguous with those of adjacent panels, and each fastening member has a body portion to extend between spaced panels, the ends of the body portion each having hook portions extending upwards and downwards respectively into adjacent grooves of the panel edges, while said body portion between adjacent panels has two upper lugs extending into contact with respective upper panels, and two lower lugs extending down and into contact with respective spaced lower panels, the fastening member constituting a one-piece connector and spacing member.

The invention according to another aspect, resides in a concealed fastening member for use with a plurality of similar members in constructing a wall of hollow units analogous to blocks built up in overlapping superimposed courses, each unit having two spaced parallel vertical panels or skins of rectangular form, said fastening member including a body adapted to extend between spaced panels of the separate skins, upper and lower hook portions at each end of the body and adapted to engage in edge grooves at the lower and upper edges respectively of said upper and lower panels of the respective skins, upper and lower locating lugs at each end of the body between said hook portions and adapted to contact the inner faces of the upper and lower panels of the respective skins, and wherein said hook portions and locating lugs are adapted in use to locate the upper and lower panels of both spaced skins fixedly relative to one another.

In applying the invention to the attachment of a cladding sheet, according to another aspect of the invention, there is provided a method of constructing a cladding sheet on and spaced from a wall surface, said cladding sheet being made up of cladding panels each of rectangular form and built up in overlapping superimposed courses with their outer surfaces vertical and coplanar, the cladding panels being held by concealed fastening members; characterized in that (1) each panel has edge grooves extending along its upper and lower horizontal surfaces to be contiguous with those of adjacent panels in the same course, and (2) each fastening member has (a) a body one end of which is operatively connected to the wall while its other outer end is connected to the panels, (b) hook portions at the outer end of the body extending upwards and downwards respectively into edge grooves at the lower and upper edges of said upper and lower cladding panels, and (c) upper and lower locating lugs at the outer end of the body inwardly of said hook portions and adapted to contact the respective inner faces of said upper and lower cladding panels whereby the hook portions and locating lugs in use locate the upper and lower cladding panels fixedly relative to one another and in spaced relationship to said wall.

For the purpose of this aspect of the invention, there is provided, broadly stated, a concealed fastening member for use with a plurality of similar members in mounting a cladding sheet on a wall, said cladding sheet being made up of cladding panels each of rectangular form arranged with their outer faces vertical and coplanar and with the panels lying in overlapping superimposed courses, said fastening members including a body having an inner end adapted to be operatively connected to the wall and its outer end adapted to be connected to upper and lower cladding sheet panels spaced from the wall;

upper and lower hook portions at the outer end of the body and adapted to engage in edge grooves at the lower and upper edges respectively of said upper and lower cladding panels;

upper and lower locating lugs at said outer end of the body inwardly of said hook portions and adapted to contact the inner faces respectively of said upper and lower cladding panels, and wherein said hook portions and locating lugs are adapted in use to locate the upper and lower cladding panels fixedly relative to one another and in spaced relationship to said wall.

Preferably, each fastening member can be cut to desired length from an elongated extruded metal bar. Where the fastening member connects to spaced skins, the extruded bar may in cross-section have two three-point connectors linked by a common body web, the middle connector being adapted to grip at the junction of two panels while the other two connectors either lie flat against inner faces of the panels or are arranged to engage in horizontal grooves provided for that purpose in the inner races of the panels.

In other aspects of the invention, there are provided double-skin walls constructed in accordance with the above described methods or employing fasteners as described, while the invention also embraces cladding sheets mounted by the methods described or using fastening members as described. Other features of the invention will be hereinafter apparent.

BEST METHOD OF CARRYING OUT THE INVENTION

In order that the invention may be more readily understood and put into practical effect, reference will not be made to the accompanying drawings, wherein.

The general principles follow those described in the U.S. Patent to Maschhoff, and thus the disclosures therein are to be taken as part hereof to the extent that same may be desirable or useful for clarity of understanding. It will be seen that I provide rectangular panels 10 to constitute opposite sides of elongated rectangular units which overlap the joints of the courses above and beneath in standard manner, and the panels 10 are both interconnected and held in spaced relationship and stable form by concealed fasteners having the numeral 11 in FIGS. 1 and 2.

Figure 1:
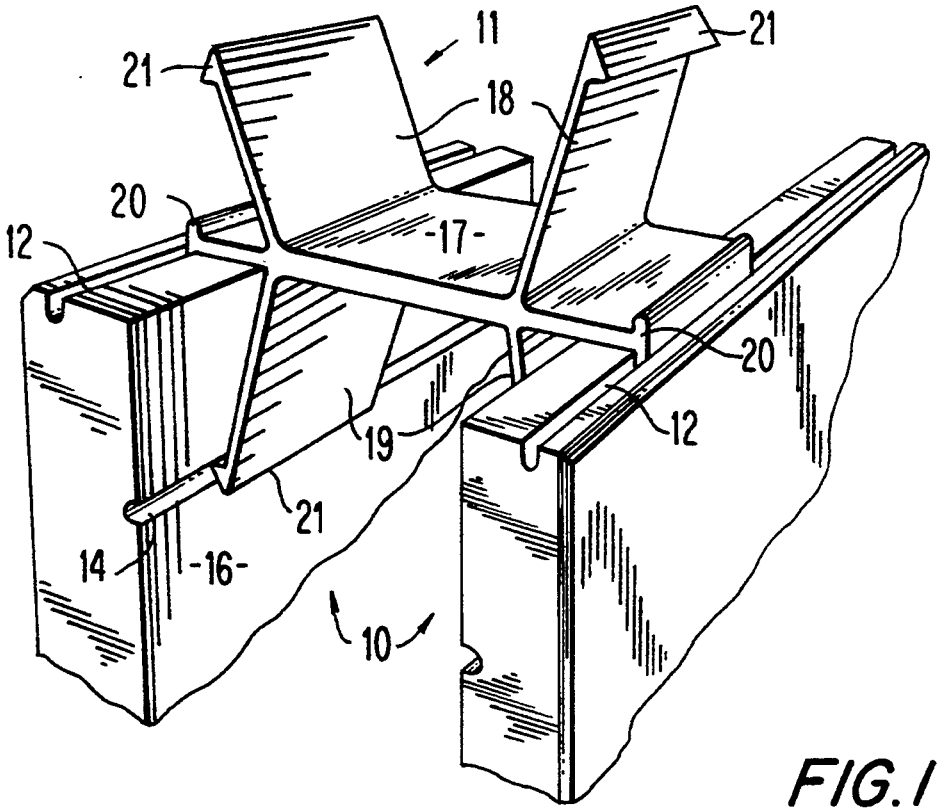
FIG. 1 shows in fragmentary perspective view the erection of two panels for one unit according to the invention, interconnected by one form of fastening member.
Figure 2:
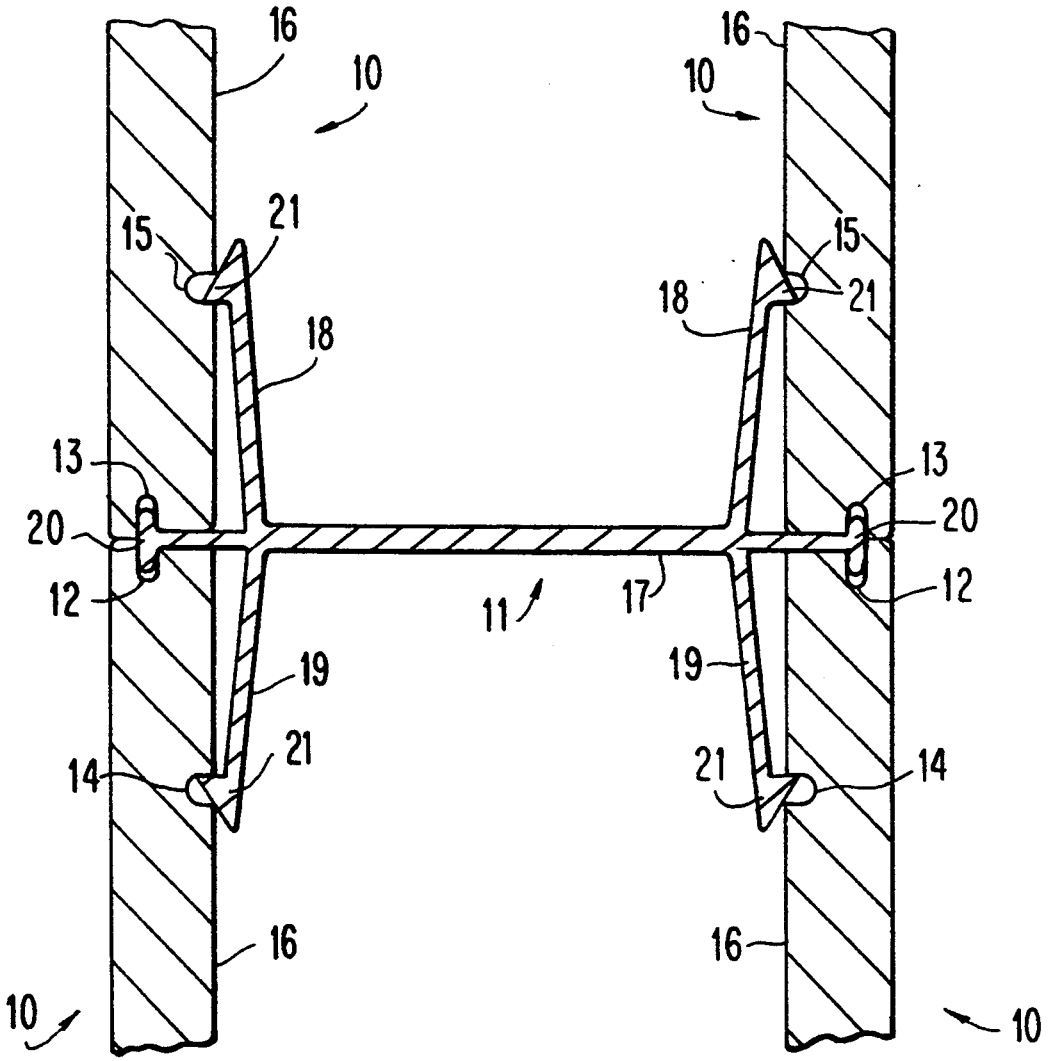
FIG. 2 shows in sectional end view the components of FIG. 1 together with parts of panels of an upper superimposed unit.

As shown in FIGS. 1 and 2, each panel 10 has a longitudinal groove 12 along its upper horizontal edge and a similar groove 13 in register along its lower edge. In this instance, each panel 10 has a horizontal groove 14 towards its upper edge and a similar groove 15 towards ito lower edge, all grooves 14 and 15 being out into the panel faces 16 which face inwards towards the space between the panels.

The fastener 11 in this case has a flat middle web or body portion 17 interconnecting two three-point connector portions in the form of a top lug 18, bottom lug 19 and double hook member 20. The two hook members 20 act to interconnect top and bottom grooves 12 and 13 to hold the courses of panels above one another while simultaneously holding the second act of panels at a fixed spacing which may for example be 110 mm in a practical example. The lugs 18 and 190 are so spaced and dimensioned as to be clear of the panel faces 16 with their terminal portions 21 shaped to hook into the grooved 14 and 15 to prevent separation of upper and lower courses as well as to provide firm gripping and a separating thrust between the spaced parallel panels for stability. Design details and dimensions may be varied as desired, and it will be seen that minimum trimming of the panel faces on the inner sides of the grooves 12 and 13 will be desirable to cater for the thickness of the web 17 and thus prevent the formation of a horizontal gap between upper and lower panels on the outer side of the double hook member 20.

Figure 3:
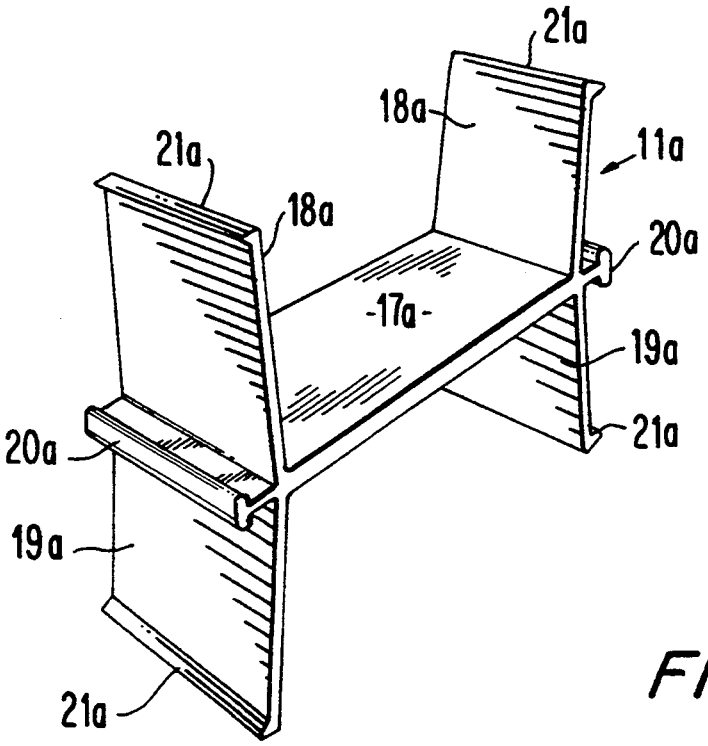
FIG. 3 shows in perspective view of a modified form of fastening member, and illustrating how all such fasteners can be cut from an extruded metal section.
Figure 4:
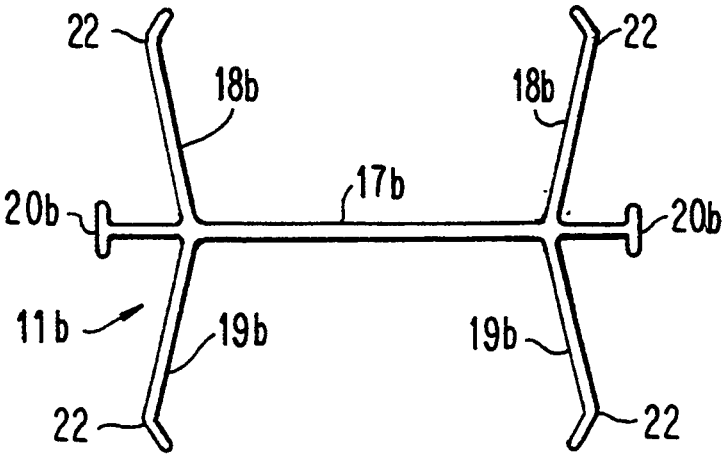
FIG. 4 is a cross-sectional view of another extruded section from which a preforred form of fastening member can be cut for use with panels which do not have engagement grooves on their inner faces.

The fastener 11 of FIGS. 1 and 2 can be modified without losing its effectiveness, one form 11*a* being shown in FIG. 3, the principal difference being that the terminal portions 21*a* are of rounded bead form instead of having a sharp hook, such beads fitting snugly into the panel inner face grooves. In the embodiment of FIG. 4, the fastener 11*b* has been modified so that its terminal portions 21*b* are not hooked to all and are turned back inwards so that junction ridges 22 will bear frictionally against the inner faces of the panels which thus do not need to be provided with grooves such as 14 and 15. In FIGS. 3 and 4 other parts are denoted by the same numerals as in FIGS. 1 and 2 with the addition of "a" or "b" respectively.

While apparatus as described and illustrated will be found very effective in achieving the objects for which the invention has been devised, it will be apparent that many further modifications of constructional detail and design may be incorporated and that all dimensions may be as required within practical considerations. The concealed fasteners may be provided in desired numbers and at desired locations but of course should preferably be used to traverse all or most joints between units of each course or tier. The invention may be employed in conjunction with standard practices so far as base mountings, wall corners and the like are concerned. Cavity-type walls may be in order in some instances, with the use of tie-rods or cyclone bolts if desired. Also, a hollow all being built may be filed with any materials as aforementioned, either progressively for preference or by a final complete pour if applicable. One type of finish may involve taping over the joints and then finishing in Granosite-like products for exterior wear, or as previously mentioned the panels may be pre-rendered as desired to give an imitation stone or other appearance.

Figure 5:
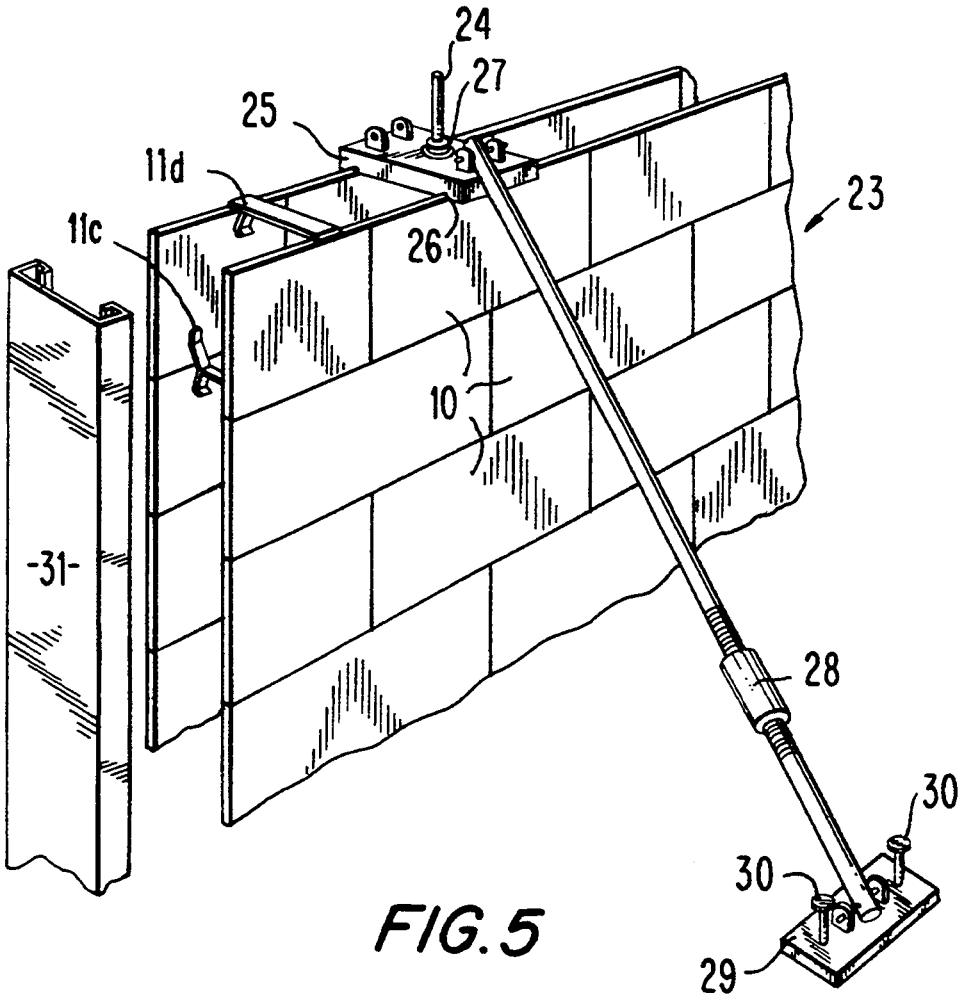
FIG. 5 shows in perspective view part of a wall constructed by means of the invention and using novel stabilizing means found useful in certain applications or certain erection conditions.

With reference to FIG. 5 of the drawings, there is shown part of a wall 23 built up of hollow block-like units as aforedescribed, having in this instance four courses of units constituted by panels 10 interconnected by fasteners such as that shown at 11*c*. A similar clip or fastener 11*d* at desired position along the top of the wall has its upper lugs removed so as not to have unnecessary upward projections. The illustrated wall 23 could for example be a long single "free-standing" wall without abutting walls providing mutual support and it could be subject to wind loading during erection. According to the invention, threaded rods such as that indicated at 24 are connected to starter bars at the base of the wall and have the panels 10 erected to enclose same. To ensure that such a threaded rod 24 remains vertical and plumb, a temporary plate 25 engages over it, having grooves 26 on its undersurface to locate the top edges of the panels 10, while a nut 27 can be tightened to effect downward compression.

Pivotally connected to the temporary plate 25 is the upper end of an adjustably extendible support rod 28 which has its lower end pivotally connected to an anchor plate 29 adapted to be secured by pegs 30 to the ground. This variable length stay or rod 28 will ensure that the wall is secure and plumb, acting to counter the effects of wind loading as the concrete or the like is poured between the panel assemblies. In this instance, a single pour of concrete is effected after the four courses of unit panels have been placed in position. There is also shown an end capping channel 31 to be fitted vertically to the and of the wall structure prior to pouring. The threaded rods 24 may of course be used in addition to or in place of vertical reinforcing bars. There may be a selected number of threaded rods 24 at desired positions, each having a stay rod 28 so that the wall frame may be plumbed as necessary and secured before pouring, during pouring and for as long as necessary after pouring.

Figure 6:
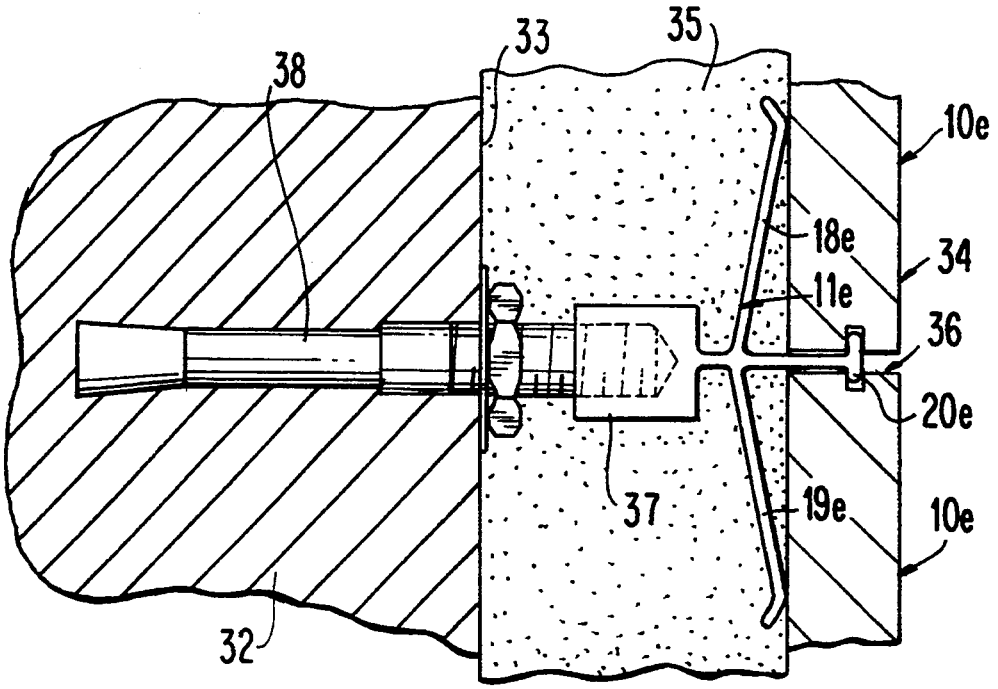
FIG. 6 shows in sectional end view a modified fastening member arranged to mount cladding sheets in spaced relationship to an existing wall of known type.

The application of the fastening members of the invention to the mounting of a cladding sheet on and spaced from a wall surface will be clear from FIG. 6 which shows an existing solid wall 32 of any known type having a mounting surface 33 to which stone cladding 34 is to be secured in spaced-relationship to permit the insertion of foamed light weight cement 35 therebetween. In this case, the cladding sheet 34 is made up of cladding panels 10*e* which have similar features to those shown in FIG. 2 except that there are mortar-receiving openings 36 at the joint where the hook members 20*e* are operative. The concealed fastener 11*e* has its outer end similar to that of FIG. 4 but its inner end has a socket 37 whereby it may be operatively connected to the wall surface 33 by means of a dyna-bolt 38. Thus the wall is spaced from a cladding sheet which is equivalent to a single skin of the embodiments of FIG. 1 to 5, with the fastening member being modified to suit.

Figure 7:
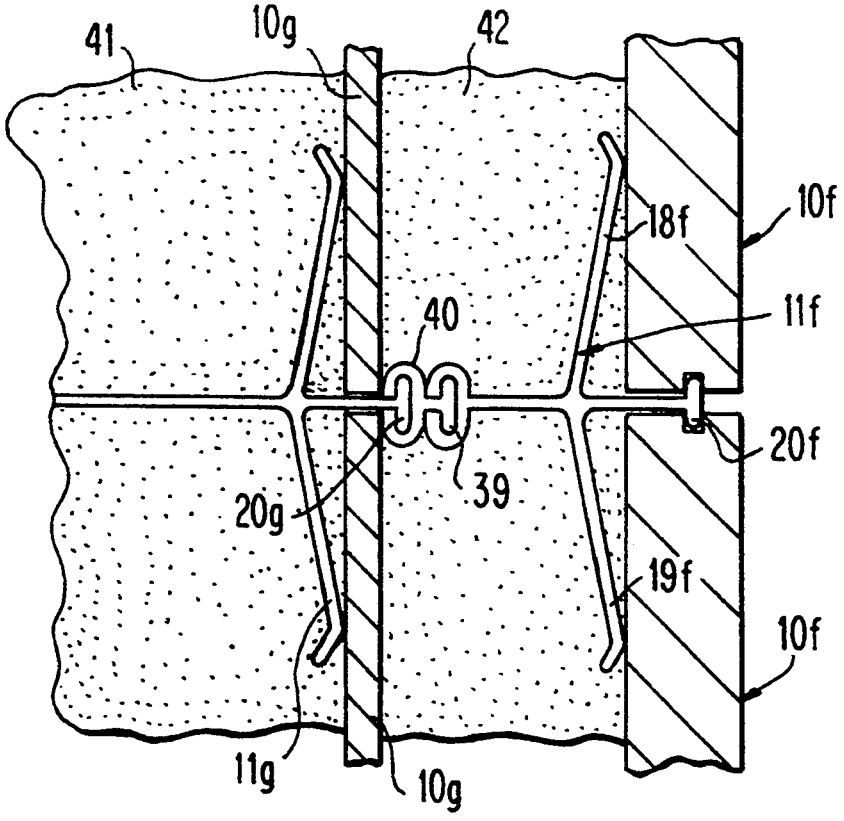
FIG. 7 shows in sectional and view yet another modified fastening member arranged to mount cladding sheets in spaced relationship to a wall embodying the basic components of the invention.

The mounting of a cladding sheet to a double-skin wall is shown in FIG. 7 which is similar to FIG. 6 so far as the panels 10*f*, hook members 20*f* and lugs 18*f* and 19*f* are concerned. However, in this case the concealed fastener 11*f* has at its inner end a lateral slot to receive the male clip portion 39 of a connector sleeve 40 for connection to the end hooks 20*g* of another fastener 11*g* identical with the fastener 11*b* of FIG. 4. It will be noted that the fastener 11*g* connects a normal thickness panel (not shown) to thin panels 10*g* and the cladding panels 10*f* are secured in spaced relationship, foamed light weight cement being interposed at 41 and 42.

It will be understood that the aforementioned and other variations will be readily apparent to persons skilled in the art and are deemed to reside within the scope and ambit of the invention as defined by the appended claims.

I claim:

1. A fastening and positioning member for use in combination with a hollow wall comprised of a first wall panel formed from building blocks arranged in overlapping superposed courses, and a second wall panel formed from building blocks arranged in overlapping superposed courses, said first and second wall panels extending substantially parallel to each other in spaced relation, said building blocks each having grooves extending longitudinally of an upper edge surface thereof and longitudinally of a lower edge surface thereof in a position registering with corresponding grooves in a next adjacent said building block, and at least one channel extending longitudinally between side edges of each said block at a position intermediate said upper and lower edge surfaces thereof on a side face of said block to be mutually presented to a corresponding side face of a said block in an opposite one of said first and second panels, said fastening positioning member comprising:

an axially elongate member providing a first body member terminating at opposite longitudinal edges thereof in oppositely extending hook members receivable within a said groove of a selected one of said building blocks; and, second body members integral with said first body member and extending at an angle to said first body member, said second body members respectively terminating at a free edge thereof in a hook member receivable in a said channel in a said side face of an associated said block;

said first body member providing for proper spacing of said first and second panels relative to each other, and said second body members being operative to prevent movement of associated said building blocks relative to each other, and transmit compressive stresses in said second body member into a compressive stress in said first body member.

* * * * *